US006166639A

United States Patent [19]

Pierce et al.

[11] Patent Number: 6,166,639

[45] Date of Patent: Dec. 26, 2000

[54] PERSONAL EMERGENCY RESPONSE SYSTEM

[75] Inventors: Douglas Pierce; Jeffrey S. Prough, both of West Bloomfield, Mich.

[73] Assignee: Advanced Marketing Systems Corporation, Southfield, Mich.

[21] Appl. No.: 09/267,241

[22] Filed: Mar. 12, 1999

[51] Int. Cl.[7] ..... G08B 21/02

[52] U.S. Cl. ..... 340/573.1; 340/531; 340/539; 340/573.4; 340/573.7; 340/689

[58] Field of Search ..... 340/573.7, 573.4, 340/573.1, 539, 531, 689

[56] References Cited

U.S. PATENT DOCUMENTS

| | | | |
|---|---|---|---|
| 3,634,885 | 1/1972 | Barkley . | |
| 3,866,204 | 2/1975 | Barkley . | |
| 4,284,986 | 8/1981 | Amortegui . | |
| 4,667,188 | 5/1987 | Schwartz . | |
| 4,829,285 | 5/1989 | Brand et al. . | |
| 4,978,946 | 12/1990 | Nordholm et al. | 340/573.1 |
| 5,396,227 | 3/1995 | Carroll et al. | 340/573.7 |
| 5,990,793 | 11/1999 | Bieback | 340/573.7 |

*Primary Examiner*—Glen Swann
*Attorney, Agent, or Firm*—Brooks & Kushman, P.C.

[57] ABSTRACT

An alarm system for sending distress information over a communication link includes a sensor to be worn by a user. Distress information is transmitted from the sensor when the user is in a predetermined position indicative of an emergency, when the user moves outside of a predetermined safety area, when the power supply supplying power to the sensor is low, when the user voluntarily activates the sensor, and when the user is not wearing the sensor. In response to the distress information, audio and/or video communication between the user and personnel monitoring the user at a remote central office is provided in response to the distress information.

12 Claims, 4 Drawing Sheets

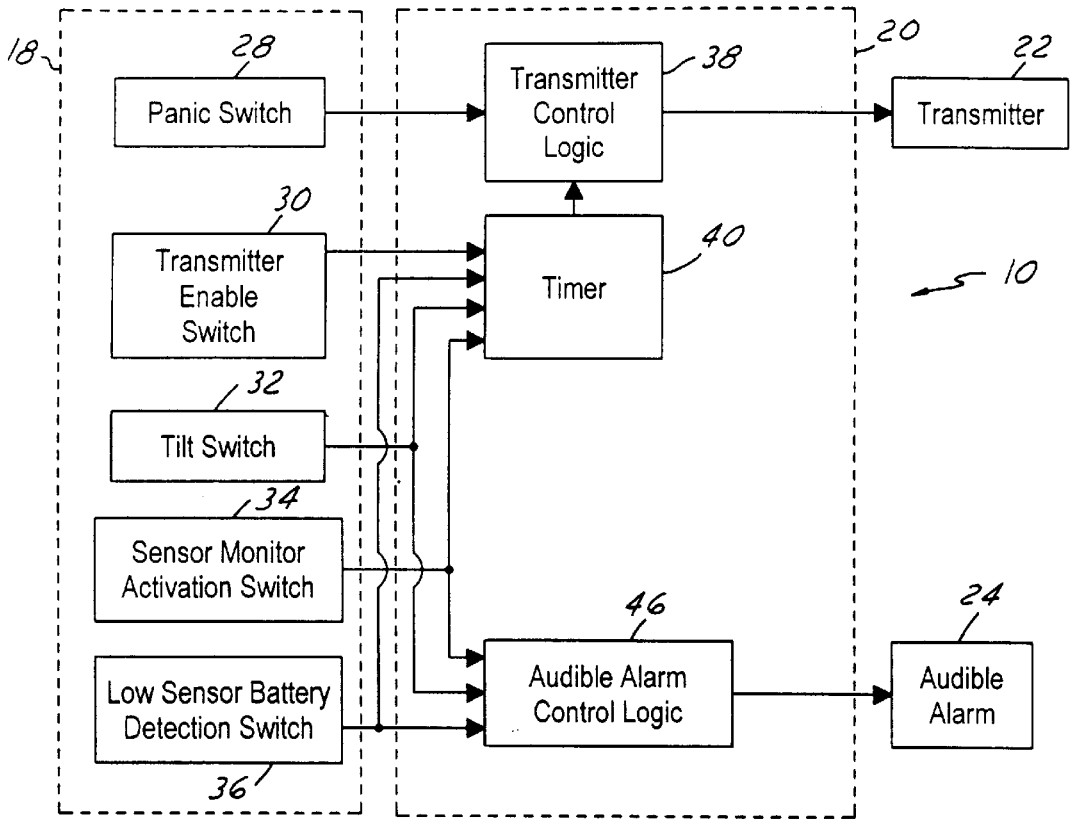
FIG. 4
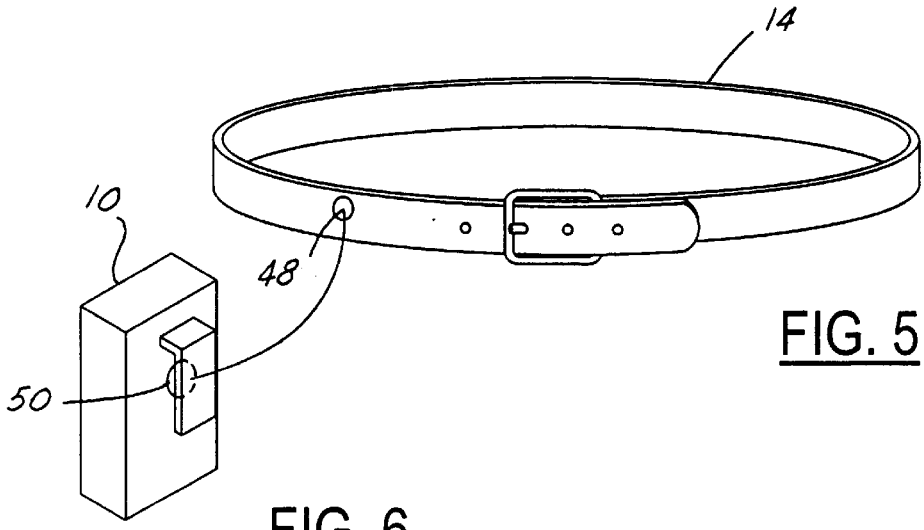
FIG. 5
FIG. 6

PERSONAL EMERGENCY RESPONSE SYSTEM

TECHNICAL FIELD

The present invention relates generally to alarms and, more particularly, to an alarm that senses when a user has encountered an emergency situation and requires assistance.

BACKGROUND ART

Great advances in the medical field have occurred, particularly in the second-half of the twentieth century. In addition, the public has generally increased its awareness of health issues and has become more concerned with proper exercise. Accordingly, the average age of the population has steadily increased. Consequently, more senior citizens tend to be living in their own homes than ever before. Being solitary and away from family unity, there is increased potential risk of unattended emergencies.

Often, persons involved in serious accidents in their own homes are found to have waited helplessly for hours before discovery. Persons who have encountered a serious accident may simply be unable to draw attention to their predicaments.

Some individuals living alone may require assistance, because of age or sickness, to simply rise up from a collapsed state. Other individuals, who are victims of multiple sclerosis, cerebral palsy, muscular dystrophy, or simply prone to dizziness or sudden illness may similarly require assistance in rising.

Unfortunately, many presently available alarms are poorly suited to meet the needs of individuals who live alone and may require assistance in the case of an emergency. Some individuals may be unconscious while in an emergency state, unable to activate any alarm manually. Other devices may be prone to set off alarms whether or not the individual requires assistance simply because the individual has moved in an erratic fashion.

U.S. Pat. No. 4,829,285, hereby incorporated by reference, discloses an improved alarm for sending distress information over a communication link. The alarm includes a tilt switch and a transmitter and is worn by a user. The tilt switch sends a tilt signal in response to being turned to a predetermined direction. Thus, should the user fall down and, for example, lie at a sever angle with respect to a vertical line, the switch will send a signal indicating the user's emergency. The transmitter receives the tilt signal and then transmits distress information over a communication link.

A disadvantage associated with the alarm disclosed in U.S. Pat. No. 4,829,285 is that automatic two way audio and voice communication needs to be established between monitoring personnel that receive the distress information from the transmitter and the user wearing the alarm. Another disadvantage associated with the alarm disclosed in U.S. Pat. No. 4,829,285 is that there needs to be a way for monitoring personnel to determine when the user moves outside of a safety area such that assistance can be provided to the user to safely move outside the safety area. A further disadvantage associated with the alarm disclosed in U.S. Pat. No. 4,829,285 is that there needs to be a way to alert the monitoring personnel when the user is not wearing the alarm.

SUMMARY OF THE INVENTION

Accordingly, it is an object of the present invention to provide an alarm system for sending distress information over a communication link when a user wearing a sensor is in a predetermined position indicative of an emergency and then providing audio communication between the user and personnel monitoring the user in response to the distress information.

It is another object of the present invention to provide an alarm system for sending distress information over a communication link when a user wearing a sensor is in a predetermined position indicative of an emergency and then providing video communication between the user and personnel monitoring the user in response to the distress information.

It is a further object of the present invention to provide an alarm system for sending distress information over a communication link when a user wearing a sensor moves outside of a predetermined safety area and then providing audio communication between the user and personnel monitoring the user in response to the distress information.

It is still another object of the present invention to provide an alarm system for sending distress information over a communication link when a sensor to be worn by a user is not being worn by the user and then providing audio communication between the user and the personnel monitoring the user in response to the distress information.

In carrying out the above objects and other objects, the present invention provides an alarm system for sending distress information over a communication link. The alarm system includes a sensor worn by a user for determining when the user is in a predetermined position indicative of an emergency. The sensor generates a distress signal upon determining that the user is in the predetermined position. A personal transceiver is operable with the sensor for receiving the distress signal from the sensor and then transmitting the distress signal over a communication link. A central office transceiver is operable with the personal transceiver for receiving the distress signal over the communication link from the personal transceiver. The central office transceiver communicates with the personal upon receiving the distress signal to provide audio communication between the user and personnel operating the central office transceiver.

Preferably, the central office transceiver communicates with the personal transceiver upon receiving the distress signal to further provide video communication between the user and the personnel operating the central office transceiver.

Preferably, the alarm system includes a sensor monitor for determining if the sensor is being worn by the user and for generating a sensor monitor signal upon determining that the sensor is not being worn by the user. The personal transceiver is operable with the sensor monitor for receiving the sensor monitor signal from the sensor monitor and for transmitting the sensor monitor signal over the communication link to the central office transceiver. The central office transceiver communicates with the personal transceiver upon receiving the sensor monitor signal to provide audio communication between the user and the personnel operating the central office transceiver.

Further, in carrying out the above objects and other objects, the present invention provides an alarm system for sending distress over a communication link. The alarm system includes a sensor worn by a user. A personal transceiver is operable with the sensor to monitor the distance there between. The personal transceiver generates an improper distance signal when the distance between the personal transceiver and the sensor is greater than a predetermined distance and then transmits the improper distance signal over a communication link. A central office transceiver is operable with the personal transceiver for receiving the improper distance signal over the communication link from the personal transceiver. The central office transceiver communicates with the personal transceiver upon receiving the improper distance signal to provide audio communication between the user and personnel operating the central office transceiver.

The above objects and other objects, features, and advantages of the present invention are readily apparent from the following detailed description of the best mode for carrying out the present invention when taken in connection with the accompanying drawings.

BRIEF DESCRIPTION OF THE DRAWINGS

FIG. 4 is a detailed bock diagram of the sensor;

FIG. 5 is a belt for allowing a use to wear the sensor;

FIG. 6 illustrates the back side of the sensor having a slot for receiving a clip provided on the belt;

BEST MODES FOR CARRYING OUT THE INVENTION

Figure 1:
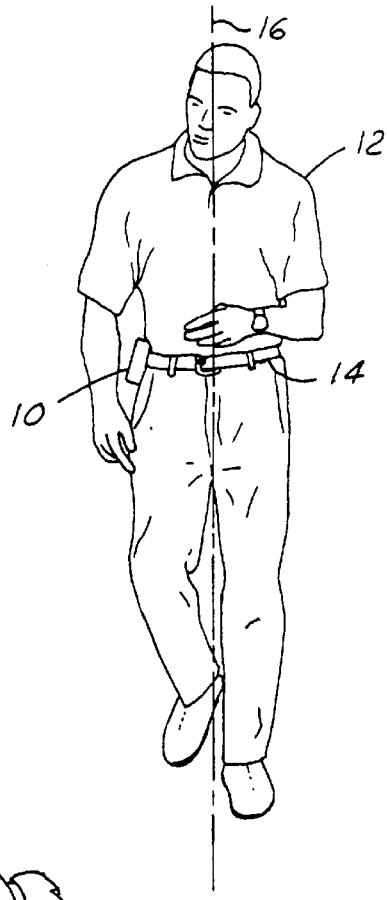
FIG. 1 illustrates a sensor in accordance with the present invention showing how the sensor is to be worn by a user.
Figure 2:
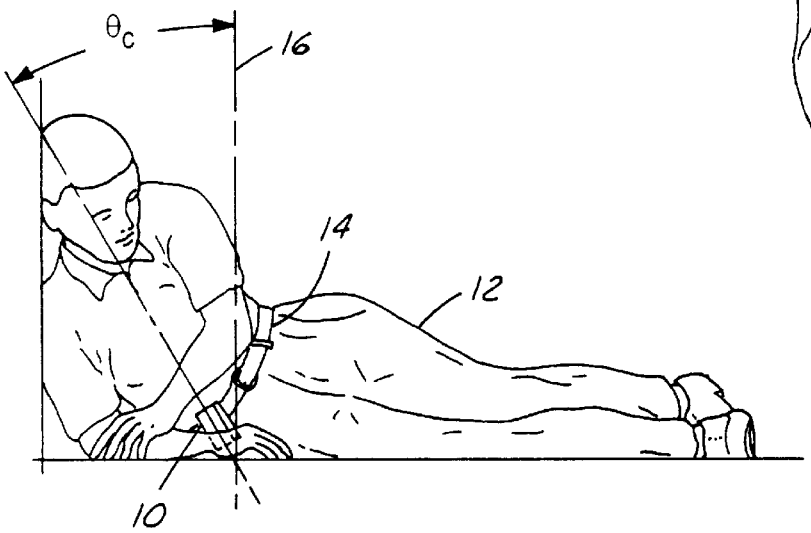
FIG. 2 illustrates how the sensor may be activated to send a distress call when the user is in a prone position.

Referring now to FIGS. 1 and 2, a sensor 10 sends distress information when a user wearing the sensor becomes unconscious or when the user manually signals the need for assistance. When a person loses consciousness, gravity normally pulls the body downward. In such cases, the individual can no longer maintain his/her body parallel to a vertical axis and the angle of the person's body changes relative to that axis. Detection of this change may be used to set off a switch that can enable a transmitter.

Sensor 10 is a pager like device worn by a use 12 on a belt 14. Sensor 10 includes an omni-directional tilt switch which is placed perpendicular with respect to belt 14. This position is chosen as the location of the tilt switch in sensor 10 because this position is often likely to be substantially parallel to a vertical axis 16 running through the user when the user is standing upright.

A critical angle $\Theta_C$ between the waist of user 12 and vertical axis 16 that causes the tilt switch in sensor 10 to activate the transmitter falls within the range of 32° to 42°. This critical angle range is sensitive enough to detect the vast majority of collapsed positions, without being overly sensitive to activate the transmitter. The most preferred critical angle for activation of the present alarm is determined to be 37° from vertical axis 16.

Figure 3:
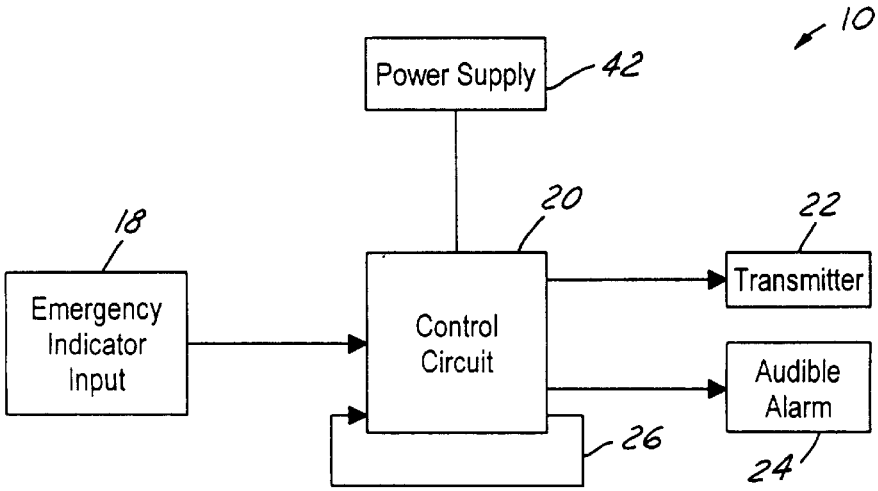
FIG. 3 is a block diagram of the sensor.

Referring now to FIG. 3, sensor 10 generally includes an emergency indicator input 18 interfaced with a control circuit 20. Control circuit 20 controls the operation of a transmitter 22 and an audible alarm 24. Control circuit 20 controls transmitter 22 to transmit distress information in case of an emergency. Control circuit 20 controls audible alarm 24 prior to transmission of distress information to alert user 12 that the distress information will be transmitted unless the user desires otherwise. Control circuit 20 also includes a user feedback circuit 26. User feedback circuit 26 enables user 12 to know the state of sensor 10 in order to manually terminate the transmission of distress information. A power supply 42 such as a battery is connected to control circuit 20 to provide power to sensor 10.

Referring now to FIG. 4, emergency indicator input 18 includes a panic switch 28, a transmitter enable switch 30, a tilt switch 32, a sensor monitor activation switch 34, and a low sensor battery detection switch 36. Control circuit 20 includes transmitter control logic 38, timer 40, and audible alarm control logic 46. Control circuit 20 monitors the inputs of emergency indicator input 18 and upon activation of an input controls audible alarm 24 to generate an audible alarm signal. After a predetermined time interval, if user 12 does not reenable sensor 10 in response to the audible alarm signal, then control circuit 20 controls transmitter 22 to transmit distress information.

User 12 can directly transmit distress information using sensor 10 by activating panic switch 28. Upon activation, panic switch 28 provides a panic signal directly to transmitter control logic 38. Transmitter control logic 38 then controls transmitter 22 to transmit distress information.

Tilt switch 32 detects a change of angle of the body of user 12 relative to vertical axis 16. Should user 12 fall while working or lose consciousness while sitting or standing, the angle of the body of user 12 deviates from vertical axis 16. This deviation activates tilt switch 32. Control circuit 20 then tests for an emergency condition before controlling transmitter 22 to transmit distress information. If the deviation from vertical axis 16 is continued for more than a predetermined time interval such as ten seconds and user 12 has not manually reset (disabled) sensor 10 using transmitter enable switch 30 or has returned to the normal, upright, substantially vertical position, control circuit 20 controls transmitter 22 to transmit distress information.

Specifically, timer 40 determines if tilt switch 32 has been activated for more than the predetermined time interval. After the predetermined time interval has expired, timer 40 provides a timer signal to transmitter control logic 38. Transmitter control logic 38 then controls transmitter 22 to transmit distress information. User 12 resets timer 40 by activating transmitter enable switch 30.

As previously state, tilt switch 32 activates when the critical angle $\Theta_C$ falls within a range of 32° to 42° (no matter which direction the body of user 12 deviates from vertical axis 16). Tilt switch 32 is an omni-directional tilt switch that is sensitive to omni-directional deviations from vertical axis 16 falling within the specific critical range.

In response to activation of tilt switch 32, audible alarm control logic 46 of control circuit 20 immediately controls audible alarm 24 to generate an audible alarm signal. The audible alarm signal alerts user 12 that tilt switch 32 has been activated and that transmitter 22 will transmit distress information after the predetermined time interval unless user 12 reenables (disables) timer 40 by activating transmitter enable switch 30.

Referring now to FIGS. 5 and 6, with continual reference to FIG. 4, sensor monitor activation sensor 34 detects whether user 12 is wearing sensor 10. As previously described, sensor 10 is a pager like device worn on belt 14. Belt 14 includes a clip 48 which slips into a corresponding slot 50 provided on back of sensor 10 when user 12 is wearing the sensor on the belt. Sensor monitor activation switch 34 monitors sensor 10 to determine if clip 48 is inserted into slot 50. If clip 48 is inserted into slot 50, then sensor monitor activation switch 34 determines that user 12 is wearing sensor 10. However, if clip 48 is not inserted into slot 50, then sensor monitor activation switch 34 determines that user 12 is not wearing sensor 10. In this case, sensor monitor activation switch 34 activates.

In response to sensor monitor activation switch 34 activating, control circuit 20 tests for an emergency condition before controlling transmitter 22 to transmit distress information. If user 12 is not wearing sensor 10 for more than a predetermined time interval and user 12 has not manually reset (disabled) sensor 10 using transmitter enable switch 30 or has put sensor 10 back on, control circuit 20 controls transmitter 22 to transmit distress information.

Specifically, timer 40 determines if sensor monitor activation switch 34 has been activated for more than the predetermined time interval. After the predetermined time interval has expired, timer 40 provides a timer signal to transmitter control logic 38. Transmitter control logic 38 then controls transmitter 22 to transmit distress information. User 12 resets timer 40 by activating transmitter enable switch 30.

In response to activation of sensor monitor activation switch 34, audible alarm control logic 46 immediately controls audible alarm 24 to generate an audible alarm signal. The audible alarm signal alerts user 12 that sensor monitor activation switch 34 has been activated and that transmitter 22 will transmit distress information after the predetermined time interval unless user 12 reenables (disables) timer 40 by activating transmitter enable switch 30.

Referring now back to FIG. 4, low sensor battery detection switch 36 detects whether power supply 42 has enough power to ensure the proper operation of sensor 10. Low sensor battery detection switch 36 activates when the power provided by power supply 42 to sensor 10 falls below a predetermined level.

In response to low sensor battery detection switch 36 activating, control circuit 20 tests for an emergency condition before controlling transmitter 22 to transmit distress information. If the power falls below the predetermined level for a predetermined time period, control circuit 20 controls transmitter 22 to transmit distress information.

Specifically, timer 40 determines if low sensor battery detection switch 36 has been activated for more than the predetermined time interval. After the predetermined time interval has expired, timer 40 provides a timer signal to transmitter control logic 38. Transmitter control logic 38 then controls transmitter 22 to transmit distress information. User 12 resets timer 40 by activating transmitter enable switch 30.

In response to activation of low sensor battery detection switch 36, audible alarm control logic 46 immediately controls audible alarm 24 to generate an audible alarm signal. The audible alarm signal alerts user 12 that low sensor battery detection switch 34 has been activated and that transmitter 22 will transmit distress information after the predetermined time interval.

Figure 7:
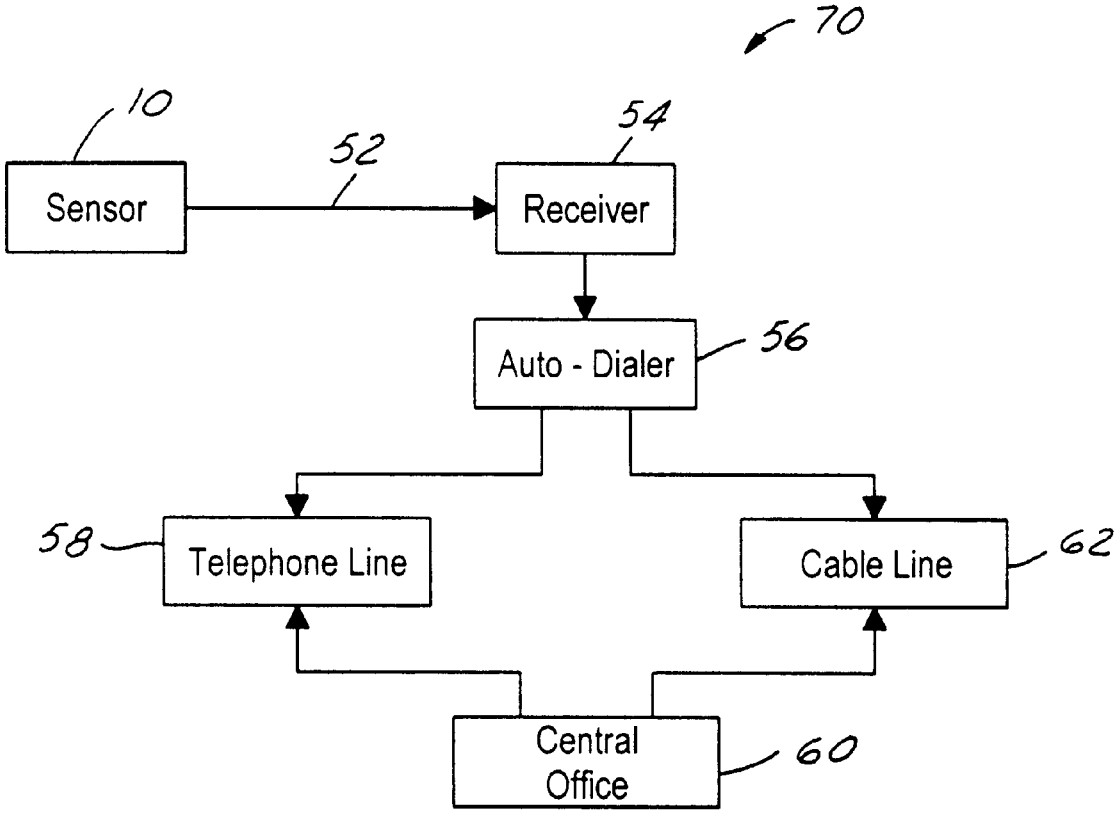
FIG. 7 is a block diagram of the alarm system in accordance with the present invention.

Referring now to FIG. 7, an overall block diagram of an alarm system 70 in accordance with the present invention is shown. Alarm system 70 includes sensor 10, a receiver 54, and a central office 60. Transmitter 22 of sensor 10 transmits distress information over a communication link 52 to a receiver 54. Receiver 54 is a stand alone device that is placed in the home of user 12. Receiver 54 is connected to an electrical outlet of the house to receive power and may include a temporary standby direct voltage source.

Preferably, communication link 52 is a radio frequency communication link such that transmitter 22 and receiver 54 communicate with radio frequency signals. Upon receiving distress information, receiver 54 activates an auto-dialer 56. Auto-dialer 56 makes a telephone call over telephone line 58 to central office 60 to provide audio communication between user 12 and personnel at the central office monitoring the user in response to the distress information. Auto-dialer 56 may also establish video communication with personnel at the central office via a cable line 62 in response to the distress information.

Another feature of alarm system 70 is that sensor 10 and receiver 54 exchange polling information over communication link 52. The polling information enables personnel at central office 60 to determine if user 12 moves outside of a predetermined safety area from receiver 54 while wearing sensor 10. Specifically, transmitter 22 transmits polling signals periodically to receiver 54. Receiver 54 measures the magnitude of the polling signals to determine if the magnitude is greater than a predetermined magnitude level. The magnitude of the polling signals is inversely proportional to the distance between sensor 10 and receiver 54. Thus, the predetermined magnitude level can be set to correspond to a safety distance from receiver 54 that user 12 can move about. Upon moving out of the safety area, the magnitude of the polling signal received by receiver 54 will be lower than the predetermined magnitude level.

Receiver 54 may then communicate with sensor 10 to activate audible alarm 24 to alert user 12 that the user has moved out of the predetermined safety area. Receiver 54 tests for an emergency condition before transmitting distress information. If the magnitude of the polling signal received by receiver 54 is less than the predetermined magnitude level for more than a predetermined time interval and user 12 has not manually reset sensor 10, then receiver 54 transmits distress information.

In response to a polling signal received by receiver 54 having a low magnitude, receiver 54 controls audible alarm control logic 46 to generate an audible alarm signal. The audible alarm signal alerts user 12 that the user has moved out of the predetermined safety area and that transmitter 22 will transmit distress information after the predetermined time interval unless user 12 reenables (disables) timer 40 by activating transmitter enable switch 30.

Figure 8:
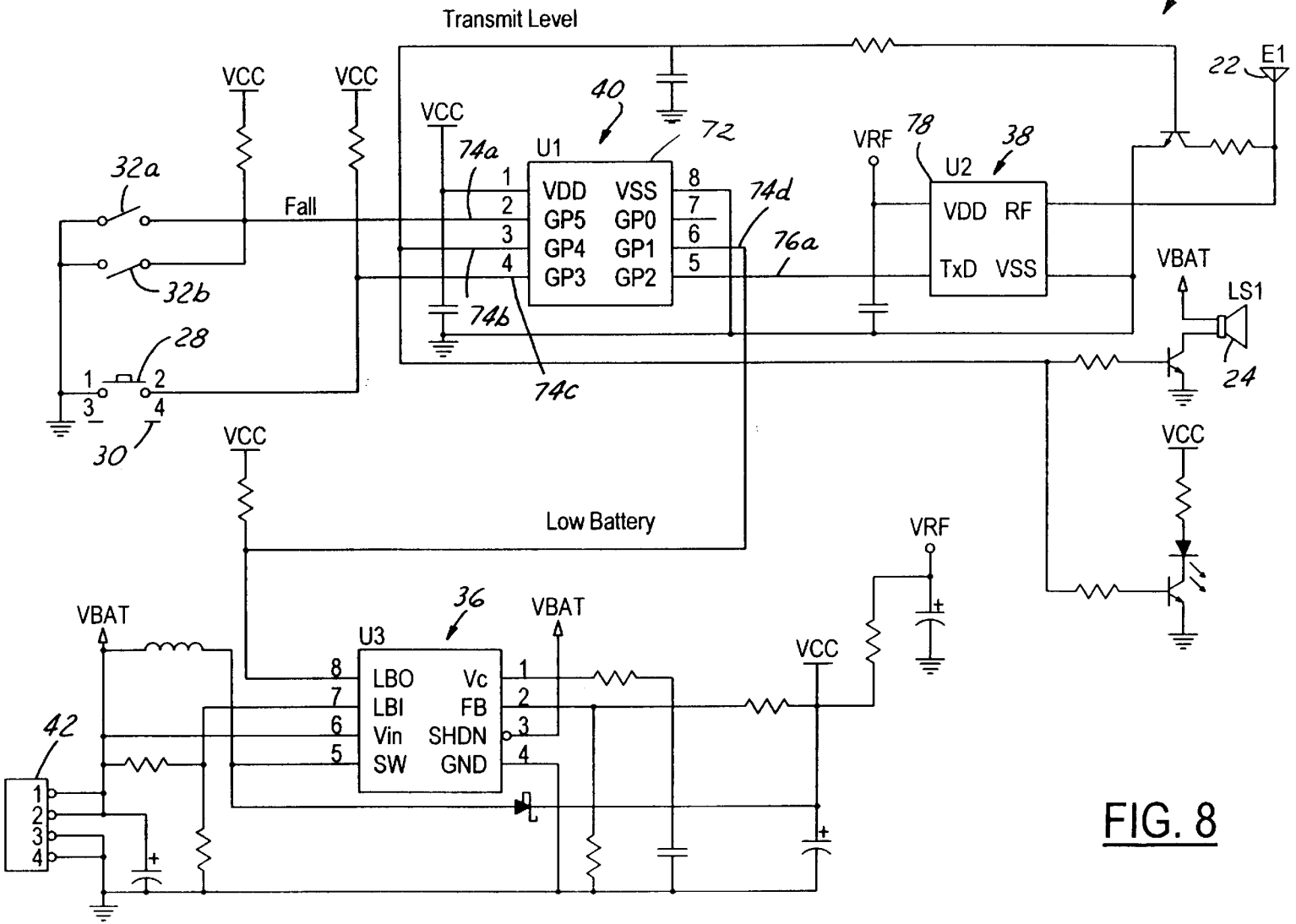
FIG. 8 is a detailed electric schematic of the sensor.

Referring now to FIG. 8, an electric schematic diagram of sensor 10 is shown. Sensor 10 includes two tilt switches 32(*a–b*). Two tilt switches are employed to provide finer resolution for selecting the range of the critical angle $\Theta_C$. Timer 40 includes a PIC12C508 microprocessor 72. Microprocessor 72 has four inputs 74(*a–d*). Input 74*a* connects tilt switches 32(*a–b*) with microprocessor 72. Input 74*c* connects panic switch 28 and transmitter enable switch 30 to microprocessor 72. Input 74*d* connects low sensor battery detection switch to microprocessor 72. Microprocessor 72 includes an output 76*a*. Output 76*a* connects microprocessor 72 to a microprocessor 78 of transmitter control logic 38. Microprocessor 78 is connected to transmitter 22.

Thus it is apparent that there has been provided, in accordance with the present invention, an alarm system for sending distress information over a communication link that fully satisfies the objects, aims, and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An alarm system for sending distress information over a communication link, the alarm system comprising:

a sensor worn by a user for determining when the user is in a predetermined position indicative of an emergency, the sensor generating a distress signal upon determining that the user is in the predetermined position;

a personal transceiver operable with the sensor for receiving the distress signal from the sensor and then transmitting the distress signal over a communication link; and a central office transceiver operable with the personal transceiver for receiving the distress signal over the communication link from the personal transceiver, wherein the central office transceiver communicates with the personal transceiver upon receiving the distress signal to provide audio communication between the user and personnel operating the central office transceiver, wherein the central office transceiver communicates with the personal transceiver upon receiving the distress signal to provide video communication between the user and the personnel operating the central office transceiver.

2. The alarm system of claim 1 wherein:

the personal transceiver and the sensor are operable to monitor the distance, therebetween wherein the personal transceiver generates an improper distance signal when the distance between the personal transceiver and the sensor is greater than a predetermined distance.

3. The alarm system of claim 2 further comprising:

an audible alarm, wherein the personal transceiver transmits the improper distance signal to the audible alarm which generates an audible alarm signal in response thereto to notify the user that the user is at a distance farther than the predetermined distance from the personal transceiver.

4. The alarm system of claim 2 wherein:

the personal transceiver transmits the improper distance signal over the communication link to the central office transceiver, wherein the central office transceiver communicates with the personal transceiver upon receiving the improper distance signal to provide audio communication between the user and personnel operating the central office transceiver.

5. An alarm system for sending distress information over a communication link, the alarm system comprising:

a sensor worn by a user for determining when the user is in a predetermined position indicative of an emergency, the sensor generating a distress signal upon determining that the user is in the predetermined position;

a personal transceiver operable with the sensor for receiving the distress signal from the sensor and then transmitting the distress signal over a communication link;

a central office transceiver operable with the personal transceiver for receiving the distress signal over the communication link from the personal transceiver, wherein the central office transceiver communicates with the personal transceiver upon receiving the distress signal to provide audio communication between the user and personnel operating the central office transceiver; and a sensor monitor for determining if the sensor is being worn by the user, wherein the sensor monitor generates a sensor monitor signal upon determining that the sensor is not being worn by the user, wherein the personal transceiver is operable with the sensor monitor for receiving the sensor monitor signal from the sensor monitor.

6. The alarm system of claim 5 further comprising:

an audible alarm, wherein the personal transceiver transmits the sensor monitor signal to the audible alarm which generates an audible alarm signal in response thereto to notify the user that the sensor is not being worn by the user.

7. The alarm system of claim 5 wherein:

the personal transceiver transmits the sensor monitor signal over the communication link to the central office transceiver, wherein the central office transceiver communicates with the personal transceiver upon receiving the sensor monitor signal to provide audio communication between the user and personnel operating the central office transceiver.

8. An alarm system for sending distress information over a communication link, the alarm system comprising:

a sensor worn by a user;

a personal transceiver operable with the sensor to monitor the distance therebetween, wherein the personal transceiver generates an improper distance signal when the distance between the personal transceiver and the sensor is greater than a predetermined distance and then transmits the improper distance signal over a communication link; and a central office transceiver operable with the personal transceiver for receiving the improper distance signal over the communication link from the personal transceiver, wherein the central office transceiver communicates with the personal transceiver upon receiving the improper distance signal to provide audio communication between the user and personnel operating the central office transceiver.

9. The alarm system of claim 8 wherein:

the sensor is operable to determine when user is in a predetermined position indicative of an emergency, the sensor generating a distress signal upon determining that the user is in the predetermined position, wherein the personal transceiver is operable with the sensor for receiving the distress signal from the sensor and then transmitting the distress signal over a communication link, and wherein the central office transceiver is operable with the personal transceiver for receiving the distress signal over the communication link from the personal transceiver, wherein the central office transceiver communicates with the personal transceiver upon receiving the distress signal to provide audio communication between the user and personnel operating the central office transceiver.

10. The alarm system of claim 8 further comprising:

a sensor monitor for determining if the sensor is being worn by the user, wherein the sensor monitor generates a sensor monitor signal upon determining that the sensor is not being worn by the user, wherein the personal transceiver is operable with the sensor monitor for receiving the sensor monitor signal from the sensor monitor.

11. The alarm system of claim 10 further comprising:

an audible alarm, wherein the personal transceiver transmits the sensor monitor signal to the audible alarm which generates an audible alarm signal in response thereto to notify the user that the sensor is not being worn by the user.

12. The alarm system of claim 10 wherein:

the personal transceiver transmits the sensor monitor signal over the communication link to the central office transceiver, wherein the central office transceiver communicates with the personal transceiver upon receiving the sensor monitor signal to provide audio communication between the user and personnel operating the central office transciver.

* * * * *